US005726379A

United States Patent [19]

Kotas et al.

[11] Patent Number: 5,726,379

[45] Date of Patent: Mar. 10, 1998

[54] PROPELLANT CHARGE COMBUSTIBLE CONTAINER FOR FIELD ARTILLERY AMMUNITION

[75] Inventors: Bernard Kotas, Bourges; Laurent Deguen, Toulouse, both of France

[73] Assignee: Giat Industries, France

[21] Appl. No.: 670,557

[22] Filed: Jun. 27, 1996

[30] Foreign Application Priority Data

Jul. 7, 1995 [FR] France ..... 95 08245

[51] Int. Cl.[6] ..... F42B 5/18

[52] U.S. Cl. ..... 102/431; 102/282; 102/700

[58] Field of Search ..... 102/282, 331, 102/430–433, 443–147, 700

[56] References Cited

U.S. PATENT DOCUMENTS

| | | | |
|---|---|---|---|
| 788,266 | 4/1905 | King et al. | 102/447 |
| 4,949,640 | 8/1990 | Reinelt | 102/282 |
| 5,052,304 | 10/1991 | Rahnenführer et al. | 102/431 |
| 5,269,224 | 12/1993 | Gonzales et al. | 102/431 |
| 5,454,323 | 10/1995 | Conil | 102/282 |
| 5,493,973 | 2/1996 | Brion et al. | 102/431 |

FOREIGN PATENT DOCUMENTS

| | | |
|---|---|---|
| 0475207 | 3/1992 | European Pat. Off. . |
| 1514293 | 5/1968 | France . |

*Primary Examiner*—Harold J. Tudor
*Attorney, Agent, or Firm*—Parkhurst & Wendel

[57] ABSTRACT

A live powder propellant charge combustible container for field artillery ammunition, having substantially the same overall dimensions as a conventional slow powder propellant charge container used for long range firing and having, means (R, E) to reduce its inner volume (7) to enclose the quantity of live powder necessary for the field artillery to be used to carry out short range firing, and some means (R, E) to be able to differentiate it, visually and by touch, from a conventional slow powder container.

11 Claims, 4 Drawing Sheets

PROPELLANT CHARGE COMBUSTIBLE CONTAINER FOR FIELD ARTILLERY AMMUNITION

The invention relates to a propellant charge combustible container for field artillery ammunition.

BACKGROUND OF THE INVENTION

Generally speaking, field artillery ammunition is made in two parts, one formed of a projectile, of the incendiary, explosive, flare type for example, and the other of a propellant charge.

More often than not, the propellant charge is divided so as to be able to alter the range of the projectile according to the military strategy being implemented. It is known to achieve this by using powder bags, each formed of a canvass bag enclosing a quantity of propellant powder, but more and more often now this division is achieved by using combustible containers. By acting on the number of containers (from 1 to 6), the quantity of powder used can be adjusted thereby altering the firing range.

However, at present, field artillery, essentially used for long range fire at over 15 km, is required to be more versatile, so as to enable it to be used for short range fire over distances of less than 10 km, for example.

The versatility of field artillery nevertheless encounters the problem of the type of powder to be used as the operation of the artillery must not be disturbed. For long range fire, a slow powder, that is, one with low gas output is used, but this type of powder is not suited to short range fire. In fact, if the quantity of slow powder is reduced, by using only two or three containers, for example, the pressure generated in the gun chamber upon firing is relatively low and causes problems of unfinished combustion, which itself leads to the presence of unburned residue.

On the other hand, live powders having relatively substantial gas output are fully adapted to short range fire, whereas this is not the case for long range fire.

Combustible containers are, for example, described in documents WO-A-8500433 and EP-A-475 207.

Document WO-A-8500433 discloses propellant charge modules formed of combustible containers filled with powder, having an axial channel in which a priming charge is placed.

Document EP-A-475 207 discloses a combustible container formed of two parts of an envelope fitting one inside the other, with a central channel enclosing a charge to facilitate priming. It is worth noting, however, that the charge is a compacted slow powder and that the outer surface of the container is rough which can cause problems during the feed phase of the gun.

SUMMARY OF THE INVENTION

The aim of the invention is to propose a combustible container able to be used in field artillery to carry out short range fire without necessitating modification of the loading mechanism of the gun.

To this end, the invention proposes a propellant charge combustible container for field artillery ammunition, which is characterised in that the propellant charge is a live powder, and in that the container (i) has the same overall bulk as a conventional slow powder propellant charge container used to carry out long range fire, (ii) comprises means to reduce its inner volume to enclose the quantity of live powder necessary for the field artillery to be used to carry out short range fire, and (iii) comprises means to be able to differentiate it, visually and by touch, from a conventional slow powder container.

According to another characteristic of the invention, the means to reduce the inner volume of the container also form the means to be able to differentiate the container from a conventional one.

Generally speaking, the container is formed of a central drum, a base and a lid, the means to reduce the inner volume of the container being located on its envelope, its base and/or its lid.

According to a first embodiment of the invention, the means to reduce the inner volume of the container are formed of a necking made on the container envelope, this necking being, for example, made by reducing the diameter of the central part of the container envelope.

According to an embodiment of the container, the base and the lid are two ring-shaped, roughly identical, parts fitted with two circular inner and outer rims, by means of which they are inserted between the central drum and the envelope, this nested assembly being a tight fit, possibly finished off by a bonding operation.

As a variant, the base and the container lid can be formed of a single part.

According to another embodiment, the container envelope is formed of two coaxial sections, aligned axially with one another and assembled together by tight fitting insertion.

In this embodiment, each section comprises a first cylindrical part in which the base or the lid of the container is inserted, and a second cylindrical part having a reduced diameter which forms part of the necking, these first and second parts being interconnected by a connecting wall of a roughly tapered shape.

To assemble the two sections of the envelope, the end of the second cylindrical part of reduced diameter of one of the sections has a slight increase in diameter forming a skirt into which the second cylindrical part of reduced diameter of the other section is inserted.

As a variant, the two sections of the envelope are roughly identical. To this end, the second cylindrical part of reduced diameter of each section comprises a half-envelope having a slight increase in diameter towards its free end to form a half-skirt into which the half-envelope of the other section, which does not have a half-skirt, is inserted.

According to a second embodiment, the means to reduce the inner volume of the container are formed by at least one indentation made in the base and/or the lid, this indentation demarcating a boss which projects inside the container, this indentation being, for example, in the form of a ring-shaped groove centered around the central drum.

According to one embodiment, the container envelope is cylindrical, and the base and lid are two similar ring-shaped parts having circular inner and outer rims by means of which they are assembled by insertion between the envelope and the central drum.

As a variant, the drum, the base and the envelope of the container can be made as a single part.

According to another characteristic of the invention, the means to reduce the inner volume of the container also comprise inner wedges made of a combustible material to wedge the granulated live powder, when the inner volume of the container is only partly filled.

By way of illustration, an inner wedge is, for example, formed of a cylinder mounted coaxially to the central drum pressing against the means to reduce the inner volume of the container, the live powder being loaded on the side of the central drum.

Generally speaking, the live powder used is in granulated, stick or pre-divided bit form, and the container is made of a combustible material such as nitrocellulose loaded cardboard around 3 mm thick.

According to a first advantage of the invention, the container can be loaded automatically by the automatic loading device which equips field artillery to enable it to carry out firing regardless long or short range fire.

According to another advantage of the invention, a crewman can easily differentiate, day or night, between this type of container and a container of slow powder of the same bulk which does not have the same characteristics of shape as are envisaged in the invention to reduce the inner volume of the container.

According to yet another advantage of the invention, the container is reversible, that is, its ends, front or back, need not to be distinguished from the other before loading.

According to yet another advantage of the invention, the container can be made using a small number of parts made by moulding, thus enabling the necessary tooling to be simplified which in turn reduces the cost of manufacture.

BRIEF DESCRIPTION OF THE DRAWINGS

Other advantages, characteristics and details of the invention will become apparent from the explanatory description which follows made in reference to the appended drawings, given by way of illustration, and in which.

DETAILED DESCRIPTION OF THE INVENTION

Figure 1:
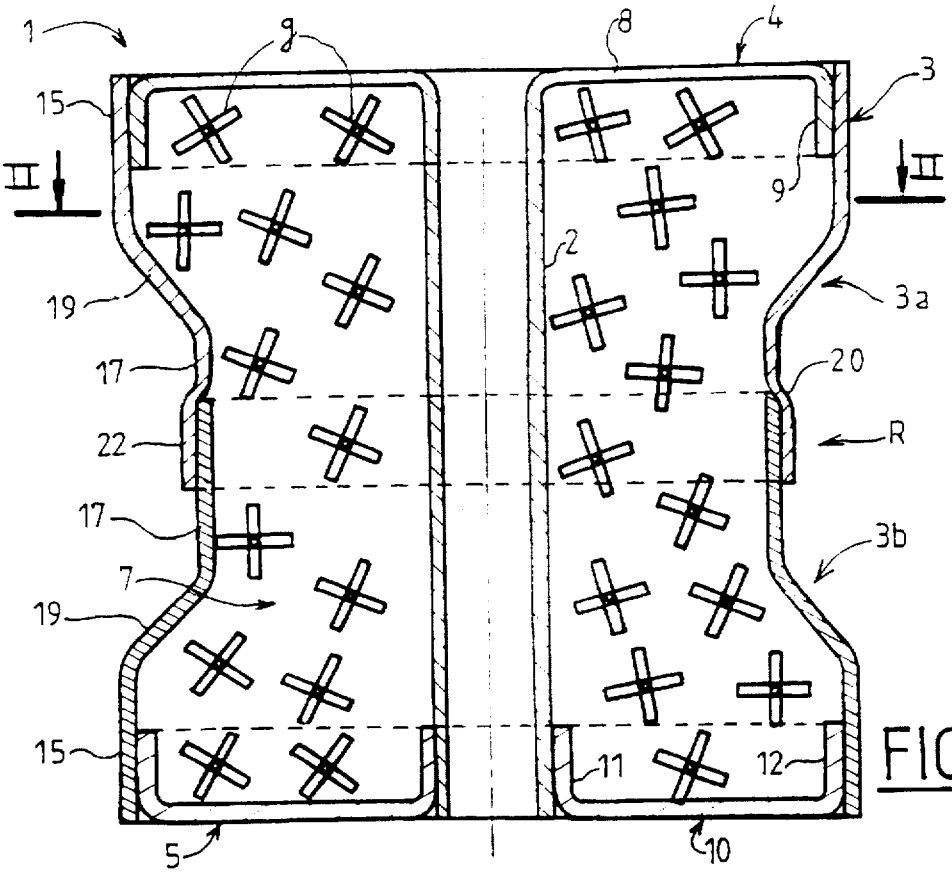
FIG. 1 is a longitudinal section view of a first embodiment of the container according to the invention.

Live powder containers according to the invention and such as depicted in the different Figures has the same bulk as conventional slow powder containers used in field artillery ammunition for long range fire, that is globally they are of the same size in height and outer diameter as those of a conventional container so that field artillery can also carry out short range fire.

Generally speaking, and in all the embodiments now to be described, a container 1 according to the invention is formed of several parts, notably: a central drum 2 whose height, in this case, defines the height of the container, a side envelope 3 which is roughly cylindrical, coaxial and centered around the drum 2, a lid 4 at one end and a base 5 at the other end. These different parts, once assembled together, demarcate a ring-shaped inner volume 7 intended to contain live powder.

Given that for an equal bulk, these containers 1 are going to be loaded with a smaller amount of live powder than the quantity of slow powder loaded in a conventional container, the inner volume 7 of these containers is to be reduced using means hereafter termed means to reduce the inner volume of the container.

According to a first embodiment of the invention, the means to reduce the inner volume 7 of the container 1 is formed of a necking R made on the side envelope 3 of the container.

Figure 2:
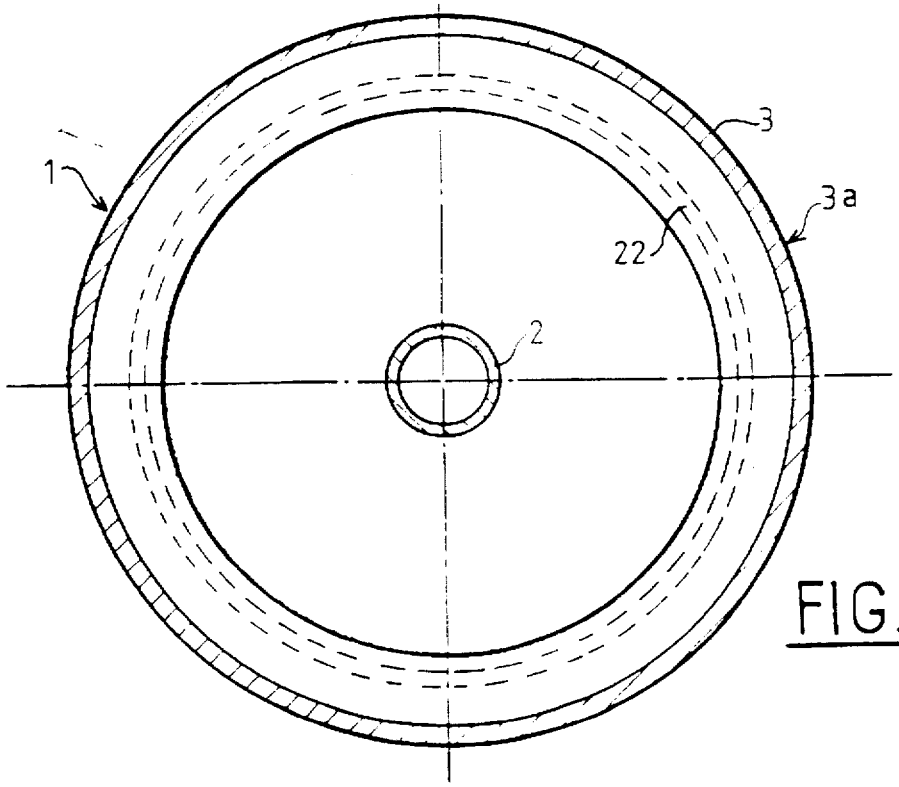
FIG. 2 is a section view along line II—II of FIG. 1.

According to a first embodiment illustrated in FIGS. 1 and 2, the central drum 2 and the lid 4 of the container are formed as a single part. More specifically, one end of the central drum 2 extends radially towards the outside by a flat ring-shaped bottom wall 8. The outer peripheral part of the bottom wall 8 is bordered by a side wall which forms a ring-shaped rim 9.

The base 5 is formed of a flat ring-shaped bottom wall 10. This bottom wall 10 is bordered inside and outside by two side walls extending on the same side of the bottom wall 10 parallel to the axis of the central drum 2 to form, respectively, a circular inner rim 11 and a circular outer rim 12. The inner diameter of the inner circular rim 11 is adjusted to that of the outer diameter of the rim of the central drum 2, whereas the outer diameter of the outer circular rim 12 is roughly equal to the of the circular rim 9 of the lid 4.

The envelope 3 is formed of two sections **3*a* and 3*b***, each comprising:

- a first cylindrical part 15 whose outer diameter demarcates the diameter of the container 1 and is equal to the outer diameter of a conventional slow powder container, and whose inner diameter is adjusted to roughly match that of the outer diameter of the circular rim 9 of the lid 4 or of the outer circular rim 12 of the base 5,
- a second cylindrical part 17 of reduced diameter and which forms part of the necking R, and
- a third connecting part 19 of a tapered shape which connects cylindrical parts 15 and 17.

Towards its free end, the second cylindrical part 17 of section **3*a* has an increase in diameter after a rim 20 to form a skirt 22 whose inner diameter is adjusted to match the outer diameter of the second cylindrical part 17 of the other section 3*b*. As a variant, the skirt 22 can be provided on section 3*b***.

The container 1 thus comprises four parts, notably: the central drum 2 extended at one end by the lid 4, two sections **3*a* and 3*b* forming the envelope 3, and the base 5**. These four parts are made by moulding and they are assembled as described hereafter.

Section **3*a* of the envelope 3 of the container is fitted around the central drum 2 such that the rim 9 of the lid 4 is inserted tightly in the cylindrical part 15 of section 3*a***.

In a similar manner, section **3*b* of the envelope 3 of the container is fitted around the central drum 2 such that its reduced diameter cylindrical part 17 is inserted tightly into the skirt 22 of envelope section 3*a* previously assembled to the lid 4** of the container.

The central drum 2, the lid 4 and the envelope 3 of the container thus assembled, mark out the inner volume 7 of the container, whose loading capacity, for a given container bulk, depends on the depth of the necking R formed in the envelope 3 and on the shape given to the connecting part 19 which consolidates the two envelope sections **3*a* and 3*b***.

The inner volume 7 of the container is loaded with live powder in a manner which will be described later on, and is then closed by means of the base 5 which is inserted tightly between the central drum 2 and the envelope section **3*b* by means of the two circular inner 11 and outer 12** rims.

The assembly operations of the different parts of the container 1 can be improved by bonding operations, known in themselves.

Figure 3:
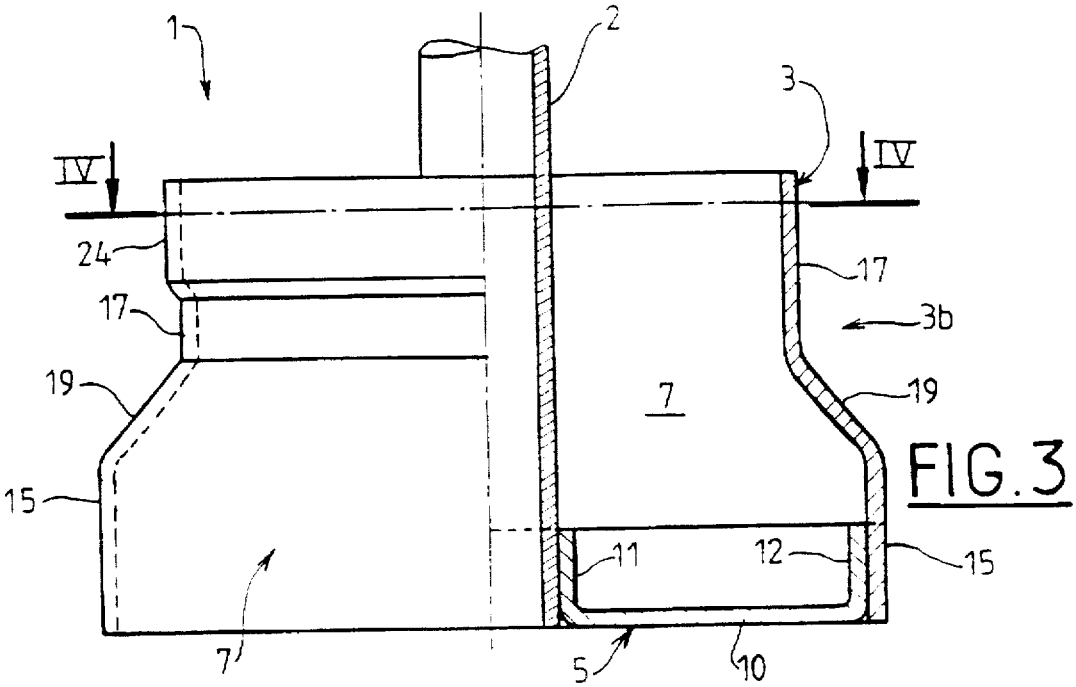
FIG. 3 is a section view along line III—III of FIG. 4 of a second embodiment of the container according to the invention.
Figure 4:
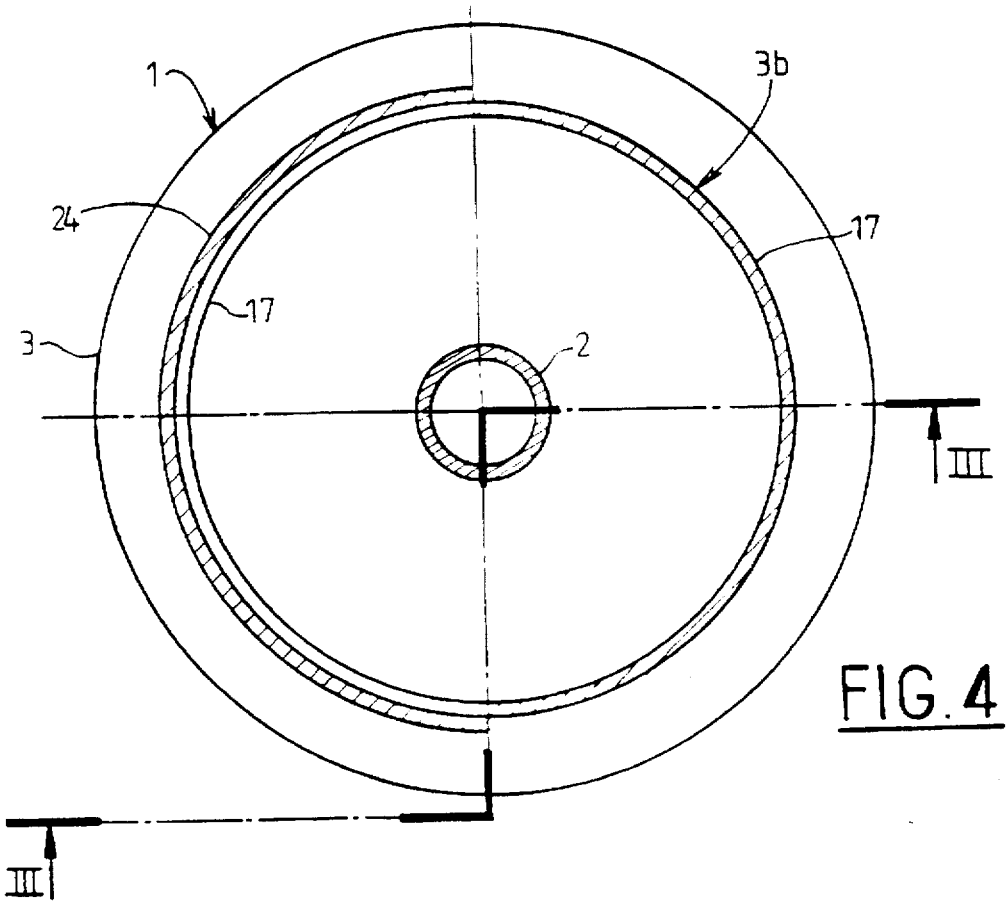
FIG. 4 is a section view along line IV—IV in FIG. 3.

A second embodiment illustrated in FIGS. 3 and 4 essentially differs from the previous one in the means used to assemble the two envelope sections 3*a* and 3*b*.

In FIG. 3, the reduced diameter cylindrical part 17 of envelope 3*b* has a skirt 24 which only extends over half the circumference and, in a symmetrical manner, the reduced diameter cylindrical part 17 of the other section 3*b* also has a halfskirt 24 which only extends over half the circumference. Thus, the two envelope sections 3*a* and 3*b* are identical in shape but are asymmetrical which respect to the axis of the central drum 2, an asymmetry which disappears when the two envelope sections 3*a* and 3*b* are inserted into one another. Such an assembly enables the number of parts making up the container to be reduced.

Figure 5:
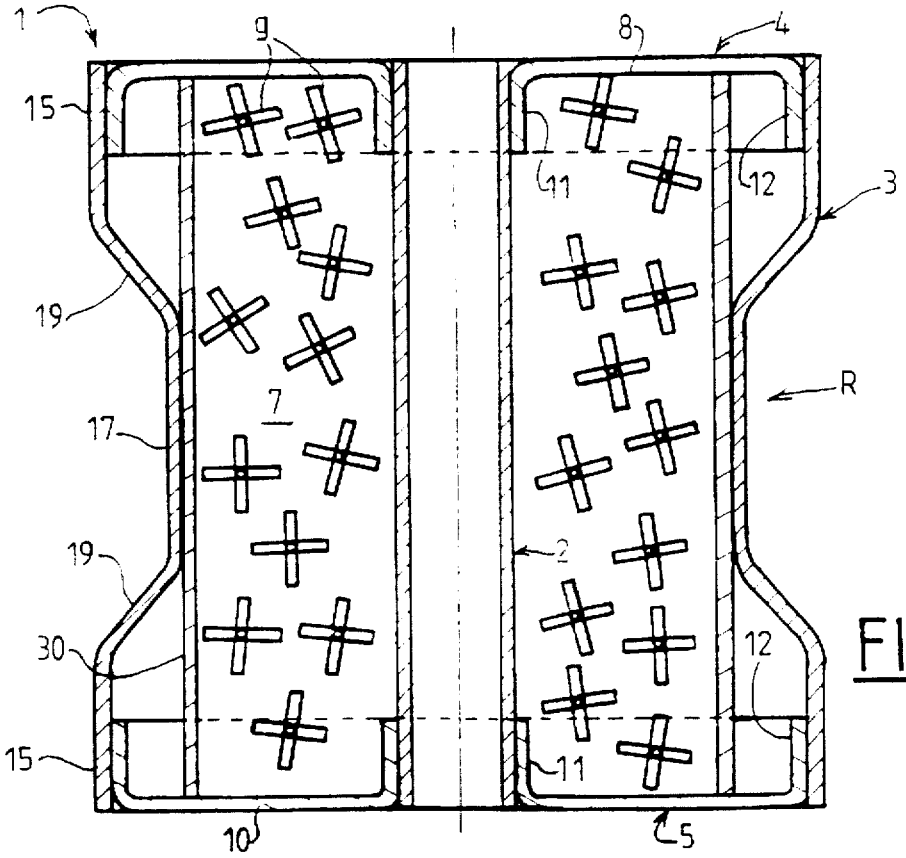
FIG. 5 is a longitudinal section view of a third embodiment of the container according to the invention.

According to a third embodiment illustrated in FIG. 5, the envelope 3 of the container is formed as a single part comprising a first cylindrical part 15 at each end, a central cylindrical part 17 of a reduced diameter and two roughly tapered connecting parts 19 placed between parts 15 and 17. In this embodiment, the lid 4 is disconnected from the central drum 2, that is the base 5 is roughly identical to the lid 4 and has a circular inner rim 11 and circular outer rim 12 by means of which the base 5 is inserted between the central drum 2 and the envelope 3.

Once the lid 4 has been fitted to the central drum 2 and the envelope 3, the inner volume 7 of the container is filled with live powder, and then the base 5 is fitted as above.

In the three embodiment variations already described, the necking R formed by a reduction in diameter of the central part of the envelope 3 gives the container a coil shape enabling it to be differentiated, both visually and by touch, from a slow powder container of the same bulk whose side envelope is perfectly cylindrical.

According to a second embodiment of the invention, the means to reduce the inner volume 7 of the container 1 are formed by at least one indentation E made in the base and/or the container lid.

Figure 6:
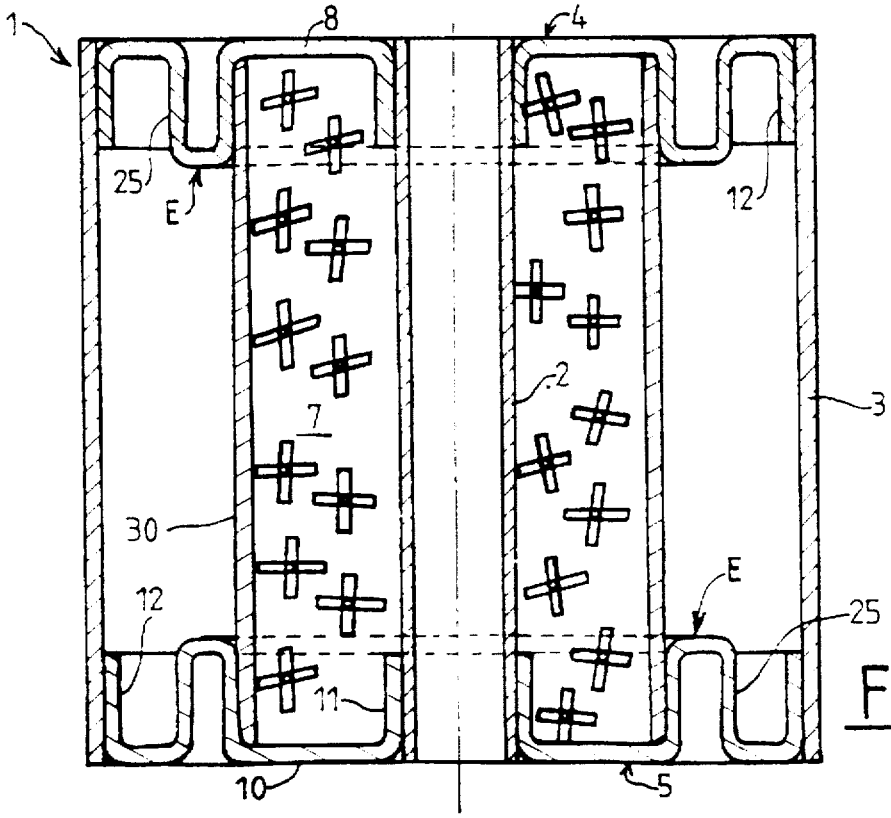
FIG. 6 is a longitudinal section view of a fourth embodiment of the container according to the invention.

According to the fourth embodiment illustrated in FIG. 6, the container 1 comprises a central drum 2, a side envelope 3 which is cylindrical, coaxial and centered around the the drum 2, a base 5 with a ring-shaped bottom wall 10 bordered on each side by a circular inner rim 11 and a circular outer rim 12, and a lid 4 with a ring-shaped bottom wall 8 bordered on each side by a circular inner rim 11 and a circular outer rim 12. These four parts are assembled by insertion as above.

An indentation E is made in the bottom wall 8 of the lid 4 and in the bottom wall 10 of the base 5. Each indentation E is in the form of a ring-shaped groove 25 which marks out a boss projecting inside the volume 7 of the container.

Figure 7:
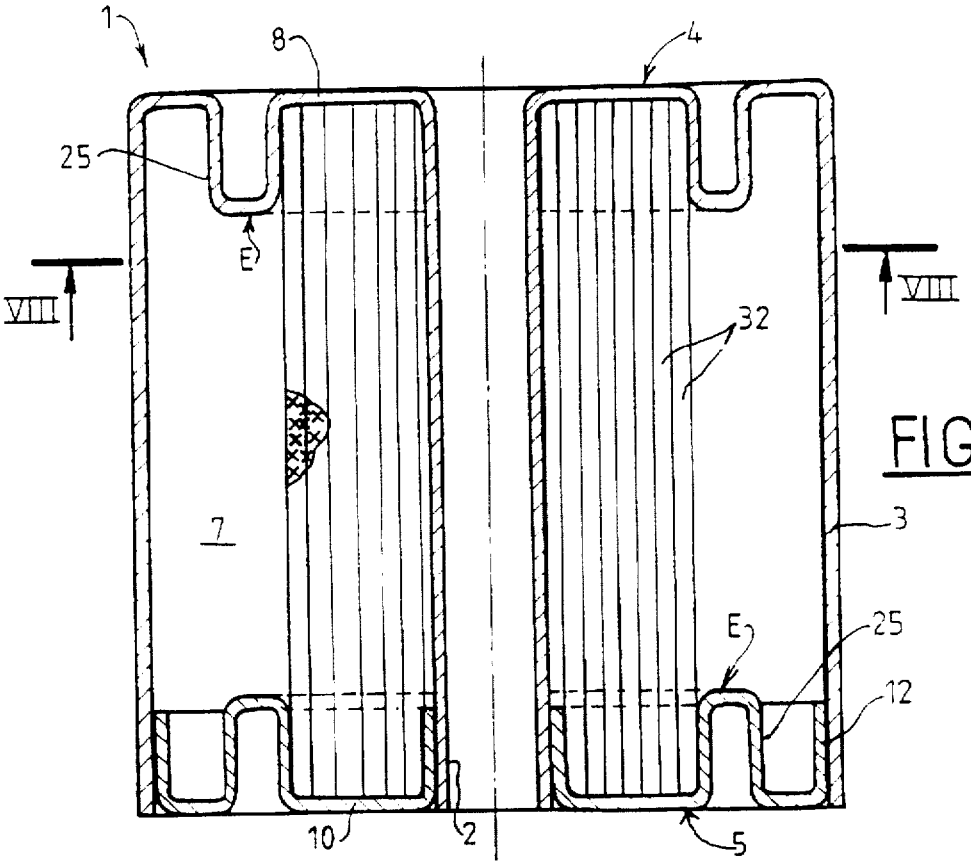
FIG. 7 is a longitudinal section view of a fifth embodiment of the container according to the invention.
Figure 8:
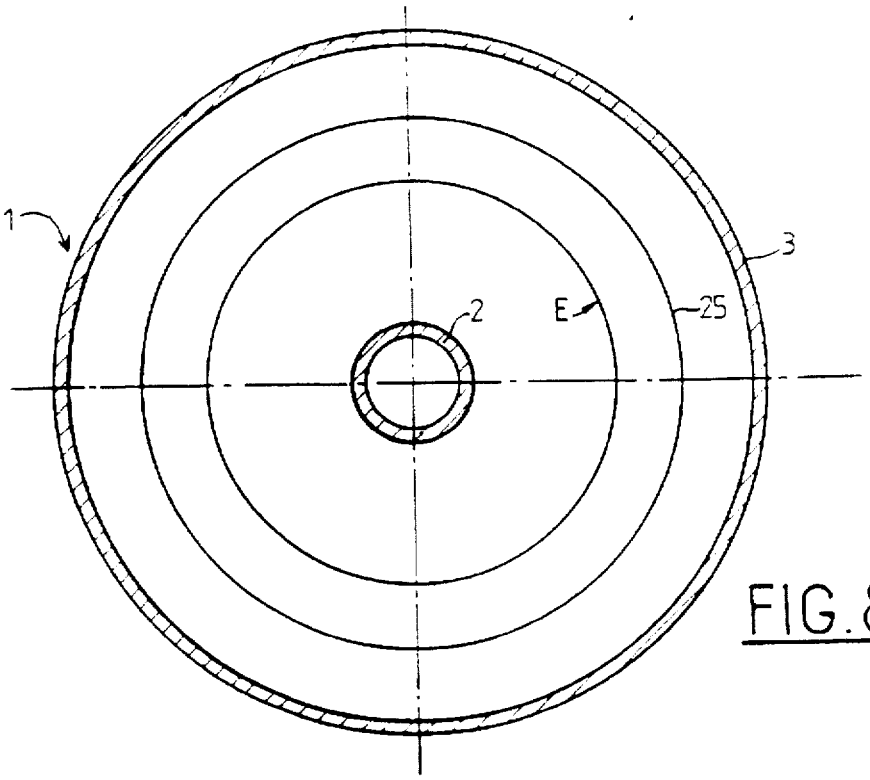
FIG. 8 is a section view along line VIII—VIII in FIG. 7.

According to the embodiment illustrated in FIGS. 7 and 8, the container 1 only differs from the one depicted in FIG. 6 in that the central drum 2, the lid wall 4 and the cylindrical side envelope 3 are formed as a single part so as to reduce the number of parts to assemble to two. As a variant, this number could be three by separating the envelope 3 and the container lid 4.

In these last two embodiments, the inner volume 7 of the container has a load capacity, for a given container bulk, which depends on the number, shape and depth of the indentations E. The latter give the container a crown shape which allows it to be differentiated, both visually and by touch, from a slow powder container whose base and/or lid do not have such indentations.

In all the embodiments, the live powder which is loaded into the container can be granulated or in stick or pre-divided bit form, and the container is advantageously made of a combustible material like nitrocellulose loaded cardboard, for example.

More specifically, concerning the granulated live powder load, the inner volume 7 of the container 1 can be either fully or partially filled. Contrary to a full fill, as shown in FIG. 1, a partial fill requires the presence of means to reduce the inner volume 7 of the container 1 to wedge the powder granules g and consolidate the container 1. As shown in FIGS. 5 and 6, these means are formed of at least one inner wedge 30 made of a combustible material, this wedge 30 being arranged inside the container 1 such that the powder granules g are preferably in contact with the central drum 2. The wedge 30 is, for example, a tube arranged coaxially to the drum 2 pressing against the reduced diameter cylindrical part 17 of the envelope 3 of the container 1 (FIG. 5) or against the side wall of the groove 25 (FIG. 6). In addition, wedges can prove to be necessary in the event that, for a similar container and for the same powder characteristics, the mass and the volume of this powder are different according to the batch in which it is manufactured.

However, when the live powder is in stick form, that is, agglomerated powder in the form of cylinders 32 which are cut to the required length, inner wedges are not necessary. In fact, these cylinders 32 are arranged parallely to the central drum 2 pressing directly against the drum and against the reduced diameter cylindrical part 17 of the envelope 3 of the container 1 or against the side wall of the groove 25 (FIG. 7).

Generally speaking, the central drum 2 of the container is intended to contain a primer charge, in a manner known in itself, and this is why, in the event of inner wedges 30 being necessary, the powder load is advantageously located on the central drum 2 side of the container 1. The height of the circular rims of the lid 4 and the base 5 is adjusted so as to make the container rigid or robust enough, and the container is perfectly reversible, that is it can be loaded indifferently by one end (base end) or the other (lid end).

What is claimed is:

1. A combustible propellant-charge container for live powder short range fire field artillery ammunition, comprising:

a base, a lid, a side envelope extending between said base and lid, said base, lid, and a central drum coaxial with said side envelope and extending between said lid and said base, and side envelope defining an inner volume of said container;

inner volume reducing means for reducing said inner volume including an annular constriction arranged substantially at a midpoint between said base and lid in said side envelope; and means providing visual and tactile identification means for identifying a live powder short range fire container.

2. A combustible container according to claim 1, wherein each of said base and lid is ring-shaped with a circular inner and outer rim, which rims abut said side envelope and said central drum.

3. A combustible container according to claim 1, wherein said central drum and said lid comprise a single part.

4. A combustible container according to claim 1, wherein said side envelope comprises two coaxial sections aligned axially with one another and assembled together by tight fitting insertion.

5. A combustible container according to claim 4, wherein each coaxial section comprises a first cylindrical part in which said base or said lid is inserted, and a second cylindrical part having a reduced diameter and forming said annular constriction, said first and second cylindrical parts being interconnected by a tapered connecting wall.

6. A combustible container according to claim 5, wherein an end of said second cylindrical part of reduced diameter of one of said coaxial sections has a slight increase in diameter thereby forming a skirt into which said second cylindrical part of reduced diameter of the other section is inserted.

7. A combustible container according to claim 5, wherein the second cylindrical part of reduced diameter of each envelope section comprises a half-envelope having a slight increase in diameter towards its free end to form a half-skirt into which the half-envelope of the other section, which does not have a half-skirt, is inserted.

8. A combustible container according to claim 2, wherein said inner volume reducing means further comprises an inner wedge comprising a combustible material to wedge in granulated live powder when the inner volume of the container is only partly filled.

9. A combustible container according to claim 8, wherein said inner wedge comprises a cylinder mounted coaxially to said central drum and pressing against an inside surface of said annular constriction, the live powder being loaded to be in contact with said central drum.

10. A combustible container according to claim 1 wherein a predetermined quantity of live powder for short range fire field artillery is disposed within said inner volume.

11. A combustible container according to claim 10 wherein, said inner volume reducing means provides visual and tactile identification means for identifying a live powder short range fire container.

* * * * *